United States Patent [19]

Oehlerking et al.

[11] 3,933,404

[45] Jan. 20, 1976

[54] STRAIN LIMITING MECHANISM

[75] Inventors: A. Dean Oehlerking, Mitchell, S. Dak.; Charles G. Stoner, New Philadelphia, Ohio

[73] Assignee: Joy Manufacturing Company, Pittsburgh, Pa.

[22] Filed: July 3, 1974

[21] Appl. No.: 485,340

[52] U.S. Cl. ..... 339/45 M; 339/59 M; 339/90 R; 339/255 R

[51] Int. Cl.[2] ..... H01R 13/54

[58] Field of Search ..... 339/45, 46, 48, 49, 59, 339/111, 255, 89, 90

[56] References Cited

UNITED STATES PATENTS

| | | | |
|---|---|---|---|
| 1,593,711 | 7/1926 | Farmer | 339/48 |
| 3,277,421 | 10/1966 | Gobrecht | 339/48 |
| 3,393,927 | 7/1968 | Kelly et al. | 339/90 R |
| 3,477,061 | 11/1969 | Stephenson | 339/90 R |
| 3,569,908 | 3/1971 | Appleton | 339/111 |

*Primary Examiner*—Joseph H. McGlynn

[57] ABSTRACT

An electrical connector assembly incorporating means for limiting cable tension to a predetermined value and precluding thereby mechanical failure of the cable.

12 Claims, 2 Drawing Figures

STRAIN LIMITING MECHANISM

Various types of large, mobile, electrically powered underground mining machines are in common use today in the coal mining industry. Typically, such machines are connected to their respective power sources through heavy duty electrical cables and connectors. Inasmuch as the cables employed for this purpose are subject to extreme wear in the harsh underground mining environment, sustaining considerable flexing, bending, surface abrasion and tension during normal use, mechanical failure thereof is a rather commonplace occurrence. In particular, the mechanical tension loads imposed upon connecting cables by the forward motion of the machines powered therethrough may become excessive and precipitate cable failure.

Low voltage pilot circuits have long been employed to eliminate some of the hazards attendant the use of high powered electrical machinery in underground mining environments. They are well known to those skilled in the art and therefore will not be described in detail here inasmuch as such description is not necessary for an understanding of the present invention. Suffice it to note that one major function of pilot circuits is to ensure that live high voltage conductors will not be exposed during makeup and takedown of electrical connections.

Figure 1:
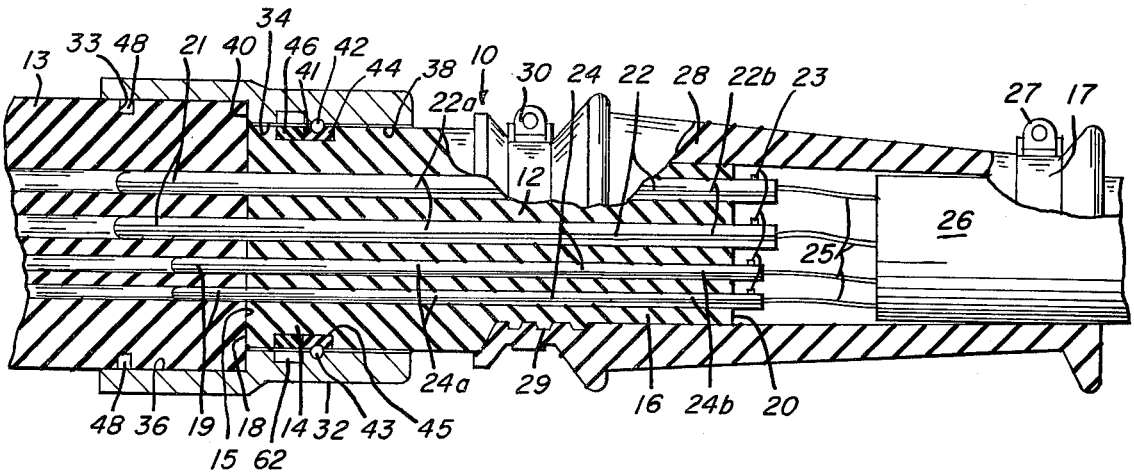
Figure 2:
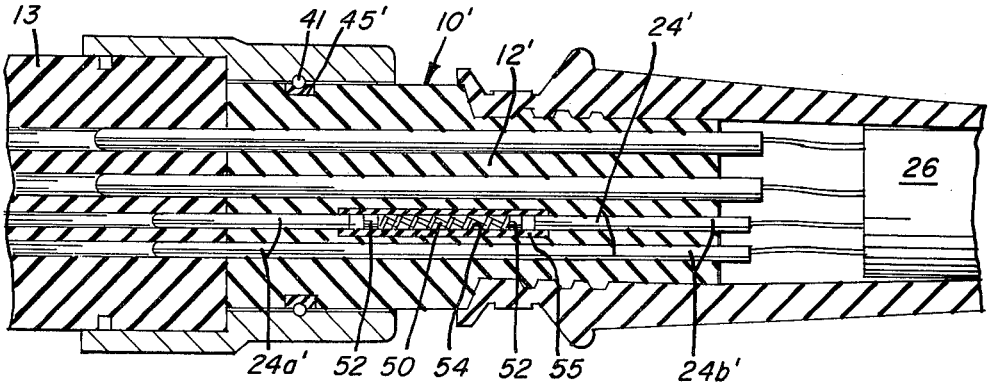

According to the present invention a pilot circuit utilized in conjunction with a deformable or elastomeric connector portion as hereinbelow described limits the mechanical tension loads imposed upon connecting cables by forward motion of the machines powered therethrough and thereby precludes failure of the cables in tension. Additional objects and advantages of the present invention will become apparent upon a reading of the following description and illustrations in which:

FIG. 1 is a longitudinal, central section through a male electrical connector assembly embodying the principles of the present invention; and FIG. 2 is a longitudinal central section of a male connector similar to that illustrated in FIG. 1 showing an alternative embodiment of the present invention.

An electrical connector assembly generally indicated at 10 in FIG. 1 comprises a rigid elongated cylindrical body member 12 formed from any suitable electrical insulating material such as neoprene. Body member 12 comprises: a free or forward end portion 14 terminating at a transverse face 18 whereat connector 10 mates with a suitable female connector 13; and a constrained or rearward end portion 16 terminating at a transverse face 20 whereat connector 10 is electrically connected to a cable 26.

Body member 12 has rigidly axially disposed therewithin and extending longitudinally therethrough a plurality of electrical power contacts 22 and pilot contacts 24. Axially adjacent forward end portions **22*a* and 24*a*, and rearward end portions 22*b* and 24*b*, of contacts 22 and 24 protrude through faces 18 and 20, respectively. The rearward extremities of contact portions 22*b* and 24*b* are suitably adapted to be electrically connected to a respective plurality of conductors 25 protruding axially from cable 26 adjacent face 20 by any suitable means, for example set screws 23 as shown in FIG. 1. The forward extremities of contact portions 22*a* and 24*a* are formed as power contact pins 21, and pilot contact pins 19, respectively, to be received within the respective cooperating sockets of female receptacle 13**.

An elongated annular sleeve 28 formed from any suitably resilient electrical insulating material, such as neoprene, rigidly retains within one end thereof body member portion 16 by any suitable means, for example cooperable load bearing threads 29 about the outer periphery of body portion 16 and the adjacent inner periphery of sleeve 28, and/or a circumferential clamp 30 (FIG. 1). The longitudinally opposed end of sleeve 28 similarly retains therewithin cable 26 in rigid engagement by means of, for example, a circumferential clamp 27 (FIG. 1) or a bonded joint (not shown). The assembly of sleeve 28 to connector body 12 and cable 26 as described hereinabove provides a structure wherein all substantial axial tension loads imposed upon the assembly during operation are transmitted from cable 26 to member 12 through sleeve 28 rather than through conductors 25.

A bearing 41 comprises a plurality of circumferentially spaced ball bearings 42 disposed in an annular raceway 44. Raceway 44 is disposed rearwardly adjacent and in longitudinal abutment with an annular band of suitably deformable material 46 within a circumferentially extending groove 45 about the periphery of body member portion 14 adjacent face 18. The outer peripheries of band 46 and raceway 44 are of substantially the same diameter as body member portion 14.

An elongated annular coupling collar or connecting member 32 formed of any suitably durable material, such as bronze alloy, has extending axially therethrough a stepped bore 34 comprising a forward coupling portion 36 and a rearward reduced diameter sleeve portion 38 of substantially the same diameter as body member portion 14. An annular forwardly facing shoulder 40 extends about the inner periphery of collar 32 at the interface of bore portions 36 and 38.

Body member portion 14 is axially rotatably secured within collar bore portion 38 by rolling engagement of ball bearings 42 with a cooperating annular groove 43 extending about the inner periphery of collar bore portion 38. In this configuration an inwardly open annular groove 62 disposed about the inner periphery of bore portion 38 forwardly adjacent groove 43 is located radially outwardly adjacent band 46, and face 18 is in approximate transverse alignment with shoulder 40. Collar bore portion 36 releasably secures therewithin receptacle 13 by, for example, engagement between an external thread 33 about the periphery of receptacle 13 and a plurality of circumferentially spaced cooperating pins 48 extending radially inwardly from the internal periphery of collar bore portion 36. When connector 10 is thus assembled contact pins 19 and 21 are electrically engaged within the respective cooperating sockets of receptacle 13 and a rearwardly facing end 15 of receptacle 13 abuts face 18.

The hereinabove disclosed structure cooperates with a conventional pilot circuit as follows to limit certain mechanical tension loads on connecting cables. Typically a pilot circuit ensures that live main power contact pins 21 will not be exposed during connection makeup and takedown by interrupting the main power circuit when pilot contact pins 19 are electrically disengaged from receptacle 13. Deformable band 46 of this invention provides means whereby a pilot circuit may be used to limit those excessive tension loads on cables, such as cable 26, caused by forward progress of the machines powered therethrough. Such loads are transmitted from cable 26 through sleeve 28 to body 12 via force transmitting joints in the manner hereinabbove indicated, and thence to receptacle 13 through body member 12, deformable band 46, raceway 44, ball bearings 42, collar 32, pins 48 and threads 33. Connector body 12 is urged rearward with respect to collar 32 in response to the tension loading being applied thereto. It is to be understood that inasmuch as receptacle 13 is rigidly engaged with collar 32 as hereinabove described, rearward displacement of body 12 with respect to collar 32 is equivalent to a separation of faces 18 and 15. As the tension loading increases, faces 18 and 15 separate and band 46 is compressed in its axial dimension. As the tension loading further increases, band 46 is further compressed in its axial dimension, the material thereof being deformed outwardly into groove 62, and faces 18 and 15 separate sufficiently that pilot contact pins 19 electrically disengage from receptacle 13 thereby interrupting power to the machine. Interruption of the power circuit arrests the forward motion of the affected machine, limits the increasing cable tension and thus precludes mechanical failure of the cable in tension. It is to be understood that pilot contact pins such as pins 19 typically have a very short electrical engagement length within their cooperating receptacle sockets, and that they will therefore disengage upon very small separation of faces 18 and 15 such as, for example, a separation of one quarter inch. Additionally, it is to be understood that in practice, band 46 may be any suitably deformable and elastomeric material which will deform sufficiently to limit maximum tension loads to a value substantially less than the ultimate strength of the cable, for example 1000 to 2000 pounds, and which upon relaxation of the tension loading will regain its original shape, exerting in the process a biasing force which will return connector 10 to its untensioned configuration with faces 18 and 15 again in abutment and pins 19 electrically engaged within receptacle 13.

The hereinabove described embodiment of the present invention teaches a strain limiting concept and is illustrative thereof. The fundamental invention may be practiced in various alternative embodiments without departing from the essence or scope thereof. For example, FIG. 2 illustrates a connector 10' utilizing the invention herein. Connector 10' is similar to the connector 10 described hereinabove, the primary distinction therebetween being that for the present embodiment the connector body 12 performs the function of previously described deformable band 46. Accordingly, in the description of connector 10' hereinbelow, like elements are assigned like numerals, and similar elements are assigned like numerals primed.

FIG. 2 illustrates a connector body member 12' formed of any suitably elastomeric or deformable electrical insulating material and having a form, structure and assembly thereof as described hereinabove with the following exceptions: deformable band 46 is not employed in this embodiment; therefore, groove 45' is of a longitudinal width to accommodate only the bearing 41 and groove 62 is not incorporated. Additionally, at least one of the pilot contacts 24' extending longitudinally through body member 12' comprises a pair of axially aligned forward and rearward contact segments **24*a'* and 24*b'* respectively, having a longitudinally extending bore 54 through a rigid, electrically insulating sleeve 55 communicating therebetween. An elongated electrically conductive compression member such as a coil spring 50 is disposed slideably within bore 54 axially intermediate an electrically connected to a pair of butt contacts 52. During operation, contact segments 24*a'* and 24*b'* communicate electrically with each other through bore 54 via contacts 52 and compression member 50. As mechanical tension loading is applied to cable 26 the tension is transmitted from cable 26 through body member 12' to receptacle 13 in substantially the manner previously described. Connector body 12' gradually elongates in response to the tension loading applied thereto, and in particular the longitudinal distance between the respective ends of contacts 24*a'* and 24*b'* communicating through bore 54 increases until compression of member 50 is completely relieved and it therefore no longer provides electrical communication between the respective contact segments 24*a'* and 24*b'***. At this point the pilot circuit is broken, the main power circuit to the machine is interrupted, and the tension increase thereby arrested.

As a further example, it is noted that an identical result is achieved if a strain limiting mechanism as described in either embodiment hereinabove is incorporated into the female rather than the male connector, or into both male and female connector parts.

Additionally, it is to be understood that various modifications to these or other embodiments may be incorporated without departing from the scope of the invention. For example: coupling collar 32 could couple to a cooperating receptacle 13 by means of a continuous mating thread rather than by a pin and groove mechanism; deformable band 46 could be replaced by a plurality of circumferentially spaced compression springs; pilot pins 19 could be replaced by butt contacts; coupling collar 32 could be rotatably secured to body member 12 by any suitable apparatus in lieu of bearing 41; and the like.

Inasmuch as it has been shown that this invention may be practiced in various embodiments and with numerous modifications without departing from the spirit and scope thereof, it is requested that the invention be interpreted broadly and limited only by the scope of the claims appended hereto.

What is claimed is:

1. An electrical connector portion comprising: an insulating body member; at least one elongated electrical contact rigidly carried by said body member and extending along an axis; said contact being adapted to move relative to a mating contact of a mating connector portion in one direction along said axis while in electrical communication with such mating contact for only a given distance; a connecting member supported on said body member for limited relative movement therebetween along said axis; deformable means extending between said members for permitting said members to relatively move at least a predetermined distance only upon a predetermined minimum force acting to move said body member relative to said connecting member in a direction opposite said one direction; and said predetermined distance being greater than such given distance.

2. An electrical connector portion as specified in claim 1 wherein said connecting member includes means adapted to be rigidly and releasably connected to such mating connector portion.

3. An electrical connector portion as specified in claim 1 wherein said deformable means is formed from a resilient elastomer.

4. An electrical connector portion as specified in claim 1 wherein said deformable means is captively received radially intermediate an inner peripheral portion of said connecting member and an outer peripheral portion of said body member.

5. An electrical connector portion as specified in claim 1 wherein said body member includes a circumferential groove extending radially inwardly from the outer periphery thereof and said deformable means is disposed within said groove.

6. An electrical connector portion as specified in claim 1 wherein said connecting member is coaxially rotatably carried by said body member.

7. An electrical connector portion as specified in claim 1 additionally comprising: at least one other elongated electrical contact rigidly carried by said body member and extending parallel to said axis; said other contact being adapted to move relative to another mating contact of such mating connector portion in said one direction while in electrical communication with such another mating contact for only a second given distance; and said predetermined distance being less than such second given distance.

8. An electrical connector portion as specified in claim 7 wherein: said at least one contact is a pilot contact being adapted to carry a relatively low voltage; and said at least one other contact is a power contact being adapted to carry a relatively high voltage.

9. An electrical connector portion as specified in claim 1 wherein said connecting member encompasses a portion of said body member adjacent one end of said body member.

10. An electrical connector portion as specified in claim 9 wherein the end of said contact adjacent said portion of said body member is longitudinally spaced therefrom.

11. An electrical connector portion comprising: a unitary insulating body member; at least one elongated contact assembly carried by said body member and extending along an axis; said contact assembly including first and second contact portions spaced along said axis a first predetermined distance from each other and an intermediate contact portion; the length of said intermediate contact portion spanning said first distance to provide electrical communication between said first and second contact portions; said body member being deformable to increase the dimension thereof in the direction of said axis upon a tensile force acting on said body member in a direction parallel to said axis; said first and second contact portions being separated from each other a second distance greater than said first distance upon said tensile force acting with a predetermined minimum magnitude on said body member; the maximum length of said intermediate contact portion being less than said second distance to interrupt electrical communication between said first and second contact portions upon said force reaching said predetermined minimum magnitude.

12. An electrical connector portion as specified in claim 11 wherein said intermediate contact portion is movably received within a substantially rigid sleeve carried by said body member.

* * * * *